US007571990B2

(12) United States Patent
Taira et al.

(10) Patent No.: US 7,571,990 B2
(45) Date of Patent: Aug. 11, 2009

(54) INKJET HEADS

(75) Inventors: Hiroshi Taira, Ichinomiya (JP); Tadanobu Chikamoto, Nagoya (JP); Yoshirou Kita, Nagoya (JP)

(73) Assignee: Brother Kogyo Kabushiki Kaisha, Nagoya-shi, Aichi-ken (JP)

( * ) Notice: Subject to any disclaimer, the term of this patent is extended or adjusted under 35 U.S.C. 154(b) by 111 days.

(21) Appl. No.: 11/692,083

(22) Filed: Mar. 27, 2007

(65) Prior Publication Data

US 2007/0229602 A1 Oct. 4, 2007

(30) Foreign Application Priority Data

Mar. 31, 2006 (JP) ..... 2006-097841

(51) Int. Cl.
*B41J 2/05* (2006.01)

(52) U.S. Cl. ..... 347/65; 347/40; 347/43

(58) Field of Classification Search ..... 347/40, 347/43, 68–72, 64–65
See application file for complete search history.

(56) References Cited

U.S. PATENT DOCUMENTS 6,869,165 B2 * 3/2005 Martin ..... 347/42
6,945,636 B2 * 9/2005 Sakaida et al. ..... 347/68
7,309,119 B2 * 12/2007 Kojima ..... 347/43
2005/0140754 A1 6/2005 Hirota et al.
2005/0157104 A1 7/2005 Hirota et al.

FOREIGN PATENT DOCUMENTS

CN 1626347 A 12/2004
CN 1636736 A 7/2005
JP 2005169839 6/2005

OTHER PUBLICATIONS

Chinese Office Action issued in corresponding Chinese Application No. 200710091951.4, dated Nov. 21, 2008.

* cited by examiner

*Primary Examiner*—Lamson D Nguyen
(74) *Attorney, Agent, or Firm*—Baker Botts, LLP

(57) ABSTRACT

An inkjet head includes a passage member having an ink passage formed therein. The ink passage has a first end and a second end opposite the second end, and the ink passage includes a supply port configured to receive an ink from an outside of the passage member and to dispense the ink into the ink passage, and a discharge port configured to dispense the ink from the ink passage to the outside of the passage member. Moreover, the supply port and the discharge port are each positioned adjacent to a predetermined end of the passage member.

19 Claims, 10 Drawing Sheets

INKJET HEADS

CROSS REFERENCE TO RELATED APPLICATION

The present application claims priority from Japanese Patent Application No. 2006-097841, which was filed on Mar. 31, 2006, the disclosure of which is incorporated herein by reference in its entirety.

FIELD OF THE INVENTION

The present invention relates to inkjet heads which eject ink onto a recording media, such as paper.

BACKGROUND OF THE INVENTION

Inkjet printers which perform a printer operation by ejecting ink droplets onto a recording medium are known in the art. The known inkjet printers include an inkjet head which includes a reservoir for storing ink, a common ink chamber which receives ink from the reservoir, and a plurality of separate ink passages which extend from the common ink chamber to nozzles via a pressure chamber. In the known inkjet head, ink is supplied to the reservoir via an ink channel which is connected to an ink supply port. When the inkjet head is filled with ink, residual air may remain with ink in the ink channel and inside the pump for feeding the ink. The residual air may flow into the reservoir via the ink supply port, which may cause the nozzles to become clogged. If the nozzles become clogged, the performance of the nozzles deteriorates with respect to ejecting ink.

To address this problem, another known inkjet head is provided with a discharge passage that discharges the air that flows into the reservoir along with the ink to the outside. This known inkjet head has a supply port for supplying ink, which is positioned adjacent to one end in the longitudinal direction, and a discharge port for discharging ink, which is positioned adjacent to the other end. In addition, a reservoir is positioned within the inkjet head, which extends in the longitudinal direction from the supply port, and the discharge passage extends from a downstream side of the reservoir to the discharge port. As a result, when the discharge port is open and ink is supplied from the supply port, air that remains in the reservoir may be discharged along with the ink to the outside via the discharge passage and the discharge port.

In this known inkjet head, with respect to the longitudinal direction, the supply port and the discharge port are positioned in the vicinity of opposite ends of the inkjet head. Consequently, connecting ink channels to the supply port and the discharge port may be complicated, and the arrangement of the ink channels connected to the supply port and the discharge port also may be complicated. Moreover, an ink passage including the reservoir and the discharge passage substantially extends throughout the entire length of the inkjet head in the longitudinal direction. As a result, there are design constraints with respect to the ink passage.

SUMMARY OF THE INVENTION

Therefore, a need has arisen for inkjet heads which overcome these and other shortcomings of the related art. A technical advantage of the present invention is that an ink channel may be readily connected and the connected ink channel may be readily removed, which may reduce the number of constrains related to designing an ink passage.

According to an embodiment of the present invention, an inkjet head comprises a first passage member comprising an ink ejection surface having a plurality of ink ejection holes formed therethrough, and a second passage member having at least one ink passage formed therein. The at least one ink passage comprises a supply port configured to receive an ink from an outside of the second passage member and to dispense the ink into the at least one ink passage, a discharge port configured to dispense the ink from the at least one ink passage to the outside of the second passage member, and an outflow port configured to dispense the ink from the at least one ink passage toward the first passage member. The supply port and the discharge port are each positioned adjacent to a predetermined end of the second passage member. The at least one ink passage also comprises a first ink passage portion which is configured to be in fluid communication with the supply port and extends from the supply port toward the outflow port, and a second ink passage portion which is configured to be in fluid communication with the discharge port and extends from the discharge port toward the outflow port Moreover, the first ink passage portion and the second ink passage portion are configured to be in fluid communication with each other in an area adjacent to the outflow port.

According to another embodiment of the present invention, an inkjet head comprises a passage member having at least one ink passage formed therein. The at least one ink passage has a first end and a second end opposite the second end, and the at least one ink passage comprises a supply port configured to receive an ink from an outside of the passage member and to dispense the ink into the at least one ink passage, and a discharge port configured to dispense the ink from the at least one ink passage to the outside of the passage member. Moreover, the supply port and the discharge port are each positioned adjacent to a predetermined end of the passage member.

Other objects, features, and advantage will be apparent to persons of ordinary skill in the art from the following detailed description of the invention and the accompanying drawings.

BRIEF DESCRIPTION OF THE DRAWINGS

For a more complete understanding of the present invention, the needs satisfied thereby, and the features and technical advantages thereof, reference now is made to the following descriptions taken in connection with the accompanying drawings.

DETAILED DESCRIPTION OF EMBODIMENTS

Embodiments of the present invention, and their features and advantages, may be understood by referring to FIGS. 1-10, like numerals being used for like corresponding parts in the various drawings.

Figure 1:
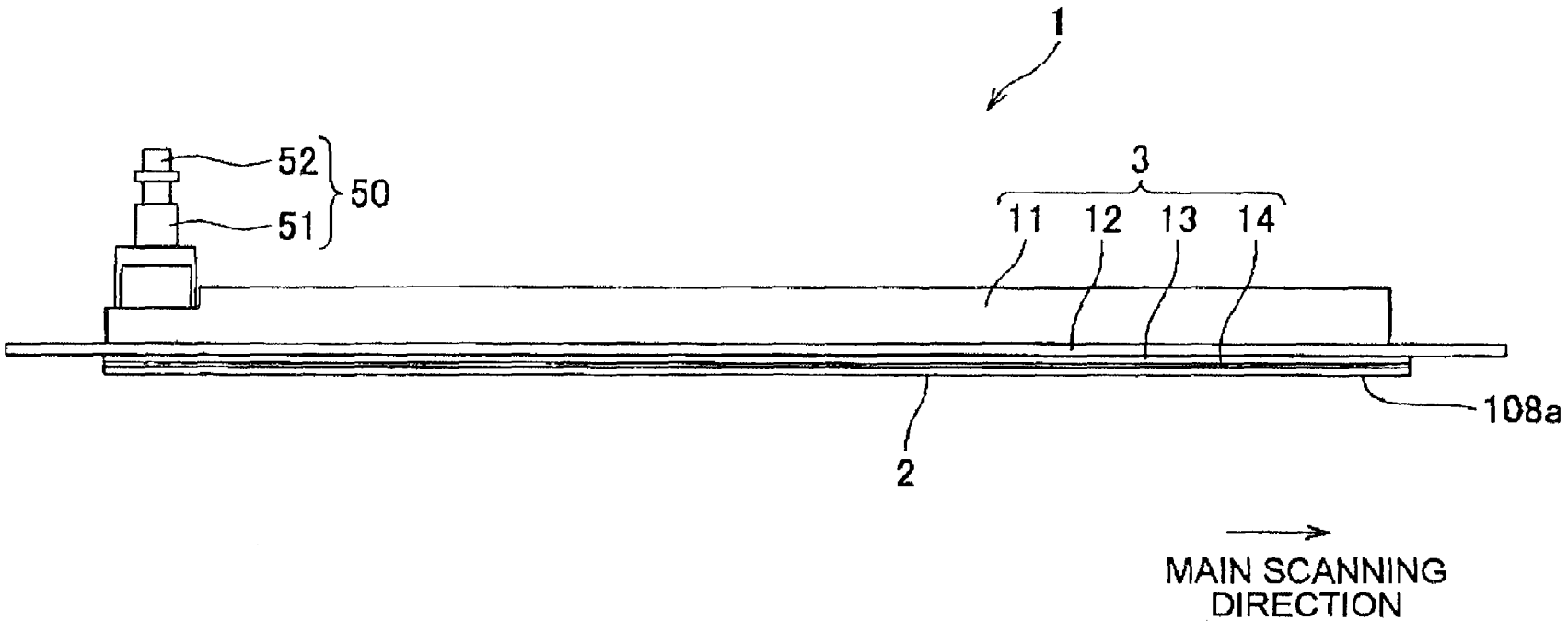
FIG. 1 is side view of an inkjet head, according to an embodiment of the present invention.
Figure 2:
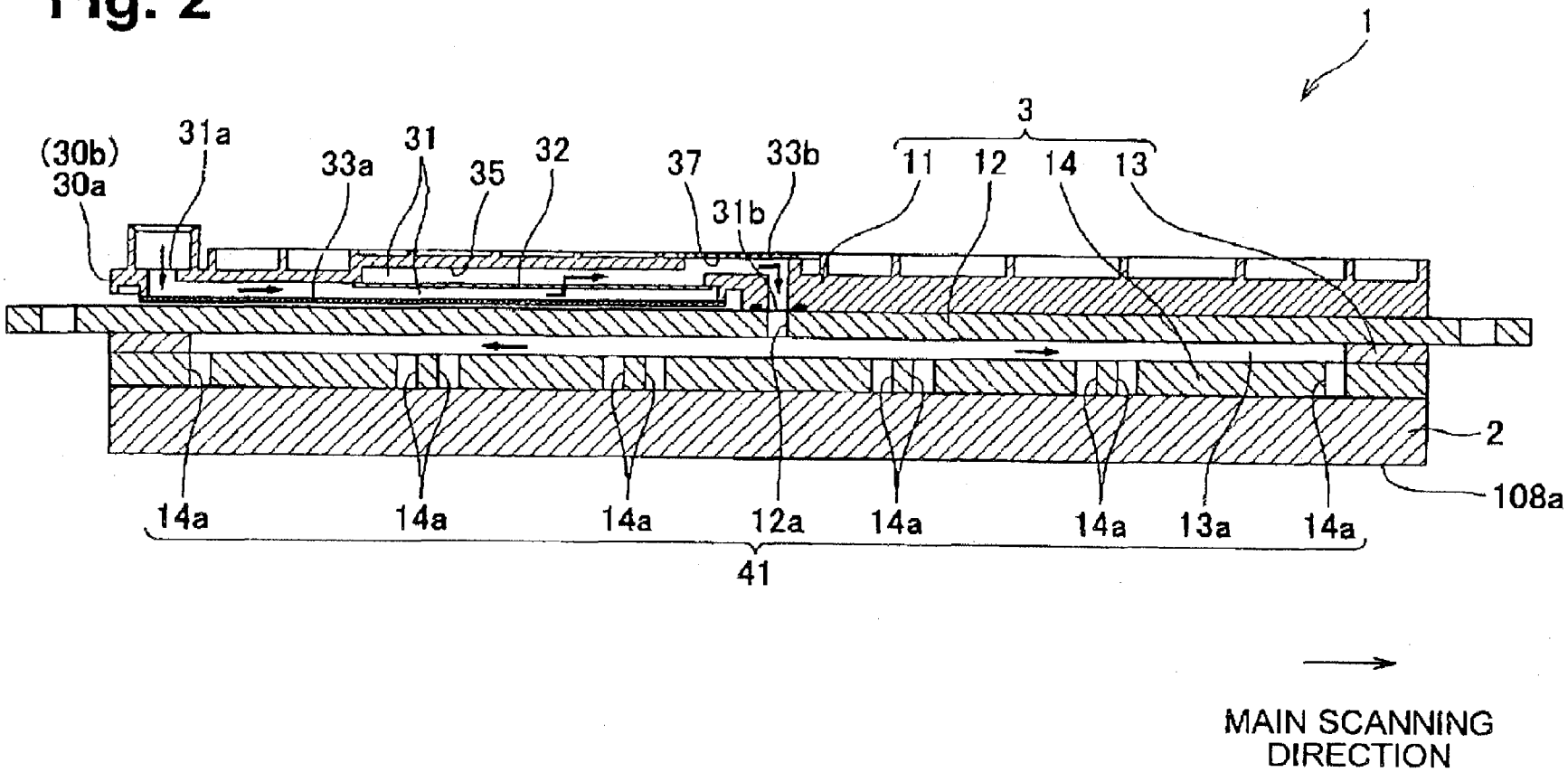
FIG. 2 is cross-sectional view along the longitudinal direction of the inkjet head of FIG. 1.

Referring to FIGS. 1 and 2, an inkjet bead 1 may extend in the main scanning direction, and may comprise a head body 2 in which an ink ejection surface (nozzle surface) 108*a* is positioned on a lower surface, a reservoir unit 3 which is configured to store ink, and a valve 50 which is attached to the reservoir unit 3.

Figure 5:
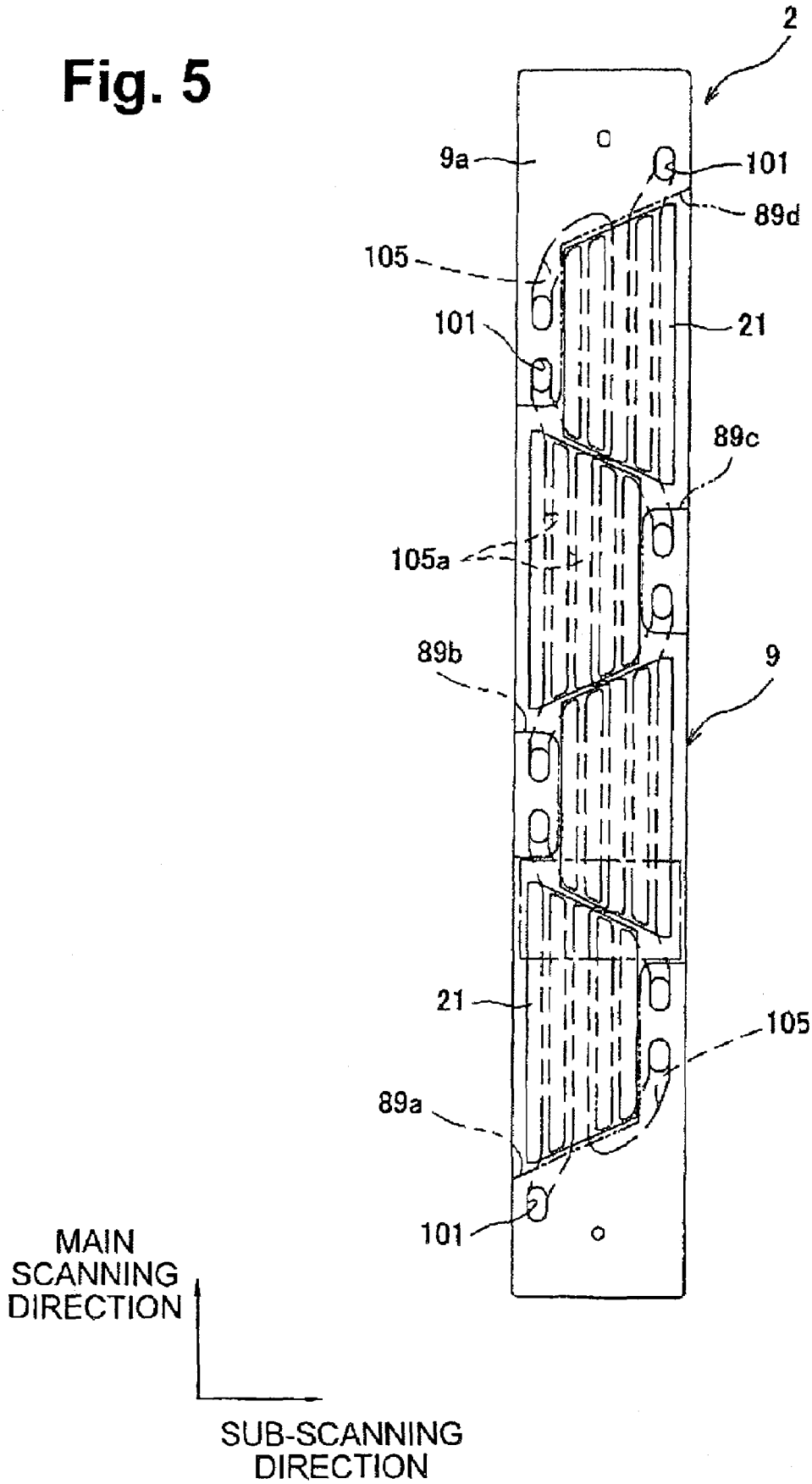
FIG. 5 is a plan view of a head body, according to an embodiment of the present invention.
Figure 6:
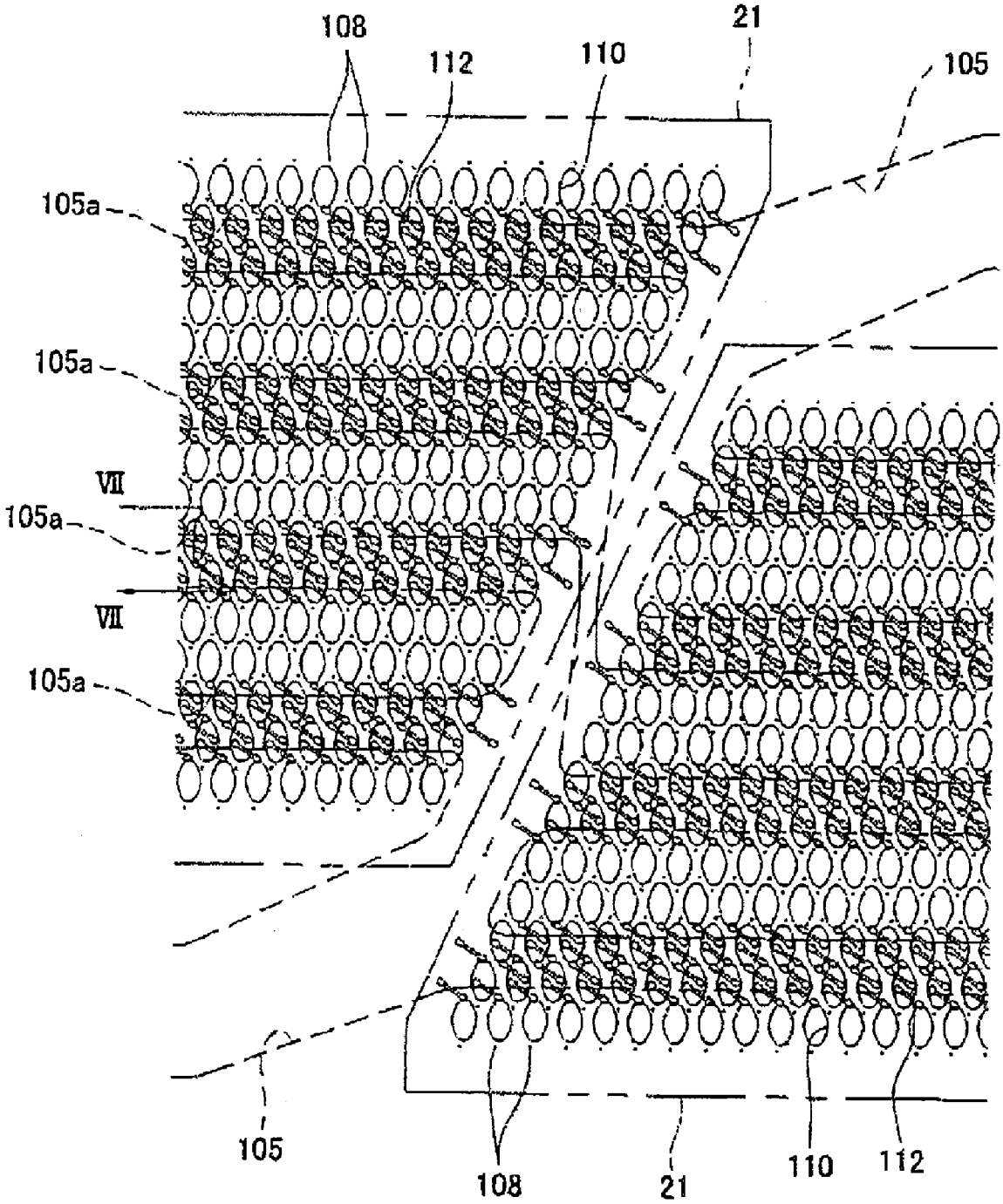
FIG. 6 is an expanded view of the area surrounded by the dashed line in FIG. 5.
Figure 7:
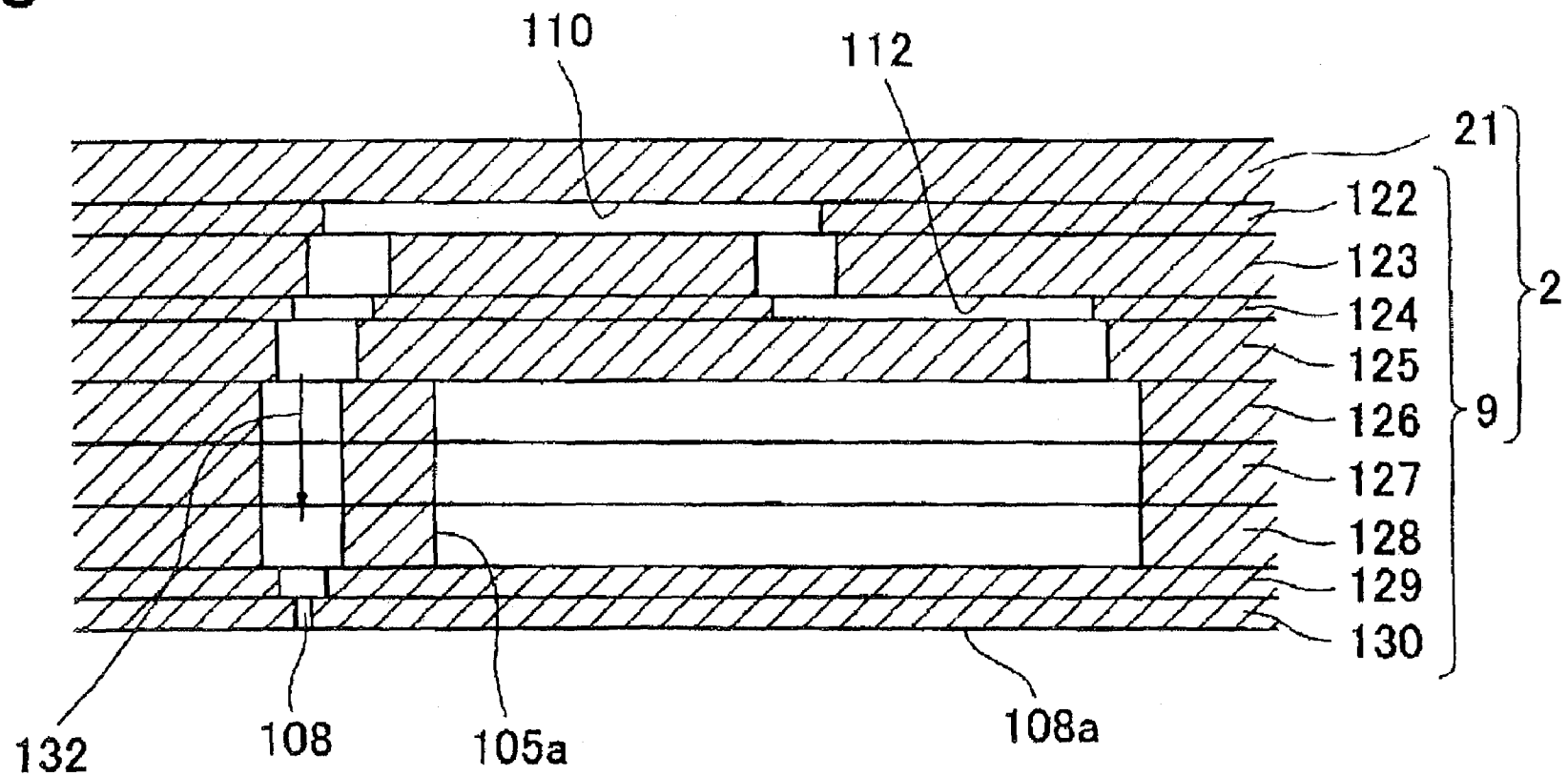
FIG. 7 is a cross-sectional view along the line VII-VII of FIG. 6.

Referring to FIGS. 2 and 3, the reservoir unit 3 comprises an ink reservoir which is configured to store ink and supplies the ink to a passage unit (first passage member) 9 (refer to. FIGS. 5-7) included in the head body 2. The reservoir unit 3 may have a laminated structure in which a passage member (second passage member) 11 which extends in the main scanning direction and three plates 12-14, e.g., metal plates, such as stainless steel plates, may be laminated together. The three plates 12-14 may have a rectangular flat tabular shape, and may extend in the main scanning direction.

Figure 3A:
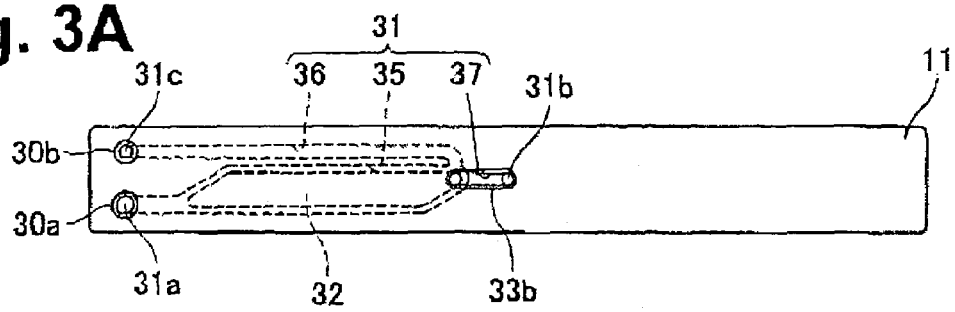
FIG. 3 is a plan view of structural elements which comprise a reservoir unit, according to an embodiment of the present invention.
Figure 3B:
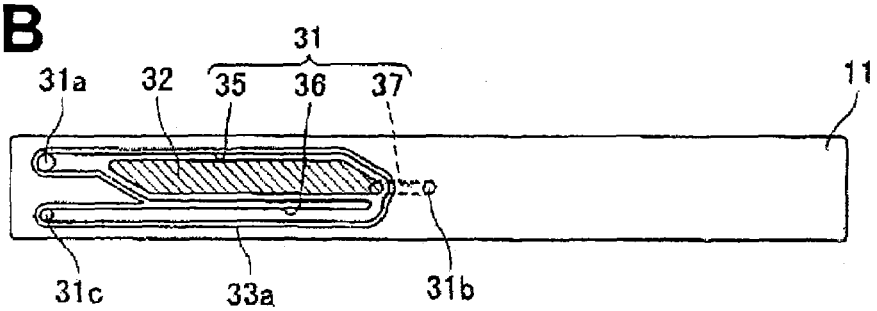

The passage member 11 may comprise, a synthetic resin, e.g., a polyethylene terephthalate resin, a polypropylene resin, or the like. As shown in FIGS. 2, 3A, and 3B, an upper reservoir 31 (ink passage) may be positioned within the passage member 11. In addition, an inflow port (supply port) 31*a* and a discharge port 31*c* may be positioned in a row in the lateral direction adjacent to one end (the left side in the figure) in the longitudinal direction of an upper surface of the passage member 11. In addition, an outflow port 31*b* may be positioned in substantially a center of a lower surface of the passage member 11.

The upper reservoir 31 may extend from a center of the passage member 11 in the longitudinal direction to the one end (the left side in the figure) in the longitudinal direction of the passage member 11. More specifically, the upper reservoir 31 may comprise a main passage (first ink passage portion) 35, a discharge passage (second ink passage portion) 36, and an outflow passage 37. The main passage 35 extends from the inflow port 31*a* to a portion adjacent to the center of the passage member 11 in the longitudinal direction, and the discharge passage 36 extends from the discharge port 31*c* to a portion adjacent to the center of the passage member 11 in the longitudinal direction. The outflow passage 37 extends from the upper surface of the main passage 35 adjacent to the center in the longitudinal direction of the passage member 11 to the center, and then continues to extend downwards to the outflow port 31*b*. In addition, the main passage 35 and the discharge passage 36 may be positioned parallel and on the same plane with the ink ejection surface 108*a*. The main passage 35 may have a parallelogram-like shape when viewed in a plan view.

A filter 32, which may has a substantially parallelogram-like shape when viewed in a plan view, may be positioned generally centrally in the thickness direction of the main passage 35. The filter 32 divides the main passage 35 into a downstream side and an upstream side. The upstream side of the main passage 35 is in fluid communication with the discharge passage 36 at an end neighboring area (the neighborhood of the other end of the passage member 11 in the longitudinal direction) at the opposite side (the right side in the figure) from the inflow port 31*a*. The end neighboring area at the opposite side from the inflow port 31*a* in the main passage 35 may be tapered toward a communication hole witch is in fluid communication with the discharge passage 36. The discharge passage 36 extends linearly along the main passage 35 and has a passage wall which may be shared with the main passage 35. In the downstream side of the main passage 35, the main passage 35 and the discharge passage 36 are in fluid communication with the outflow passage 37 at substantially a center of the passage member 11 in the longitudinal direction.

Referring to FIGS. 2 and 3B, a film, e.g., a flexible thin film, 33*a* adhered to the lower surface of the passage member 11 forms a passage wall of the lower surface of the main passage 35 and the discharge passage 36. More specifically, the main passage 35 and the discharge passage 36 are exposed to an outside atmosphere via the film 33*a* positioned between the outside atmosphere and the surface of the main passage 35 and the discharge passage 36. The film 33*a* adheres to the lower surface, such that a gap is left between the film 33*a* and a plate 12. For example, the gap may be about 0.5 mm, and the film 33*a* may be configured to be displaced within this gap. In addition, because the film 33*a* is flexible, if there is a sudden pressure fluctuation inside the main passage 35 and the discharge passage 36, the film 33*a* may function as a damper that absorbs the pressure fluctuation. In addition, referring to FIGS. 2 and 3A, a film 33*b* adhered to the upper surface of the passage member 11 forms the passage wall of the upper surface of the outflow passage 37. In an embodiment, the film 33*a* may comprise a material which is flexible and has sufficient gas barrier properties, e.g., a silica film (SiOx film) or a PET (polyethylene terephthalate) film on which aluminum film is evaporated. Accordingly, it is difficult for gas located outside of the inkjet head 1 to enter the upper reservoir 31 via the film 33*a*. Moreover, the film 33*b* may comprise the same material as the film 33*a*.

A supply side joint portion 30*a* connected to the inflow port 31*a* and a discharge side joint portion 30*b* connected to the discharge port 31*c* are positioned in the upper surface of the passage member 11. The supply side joint portion 30*a* is connected to an ink channel for supplying ink to the inkjet head 1. The discharge side joint portion 30*b* is connected to the valve 50 (refer to FIG. 1).

Figure 3C:
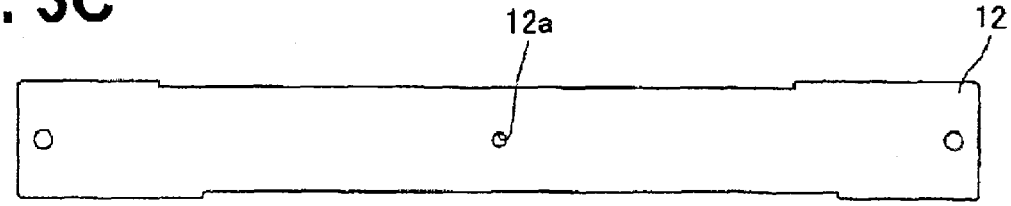
Figure 3D:
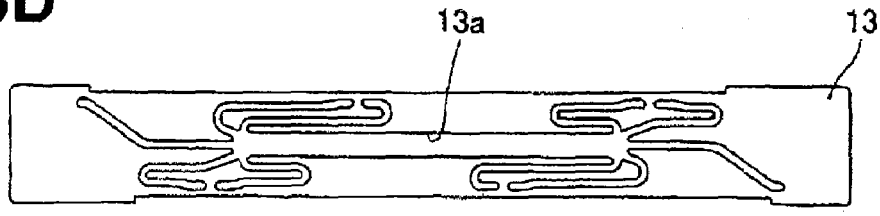
Figure 3E:
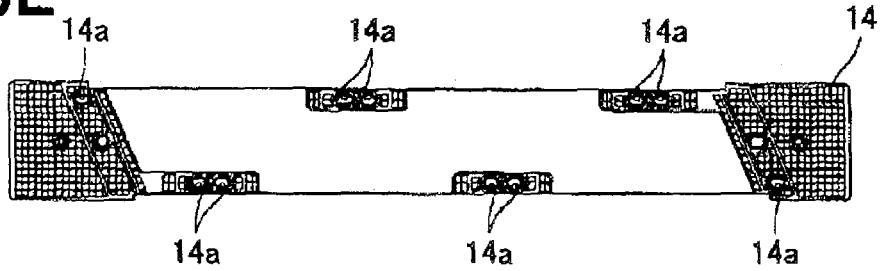

Referring to FIGS. 2 and 3C, a through hole that forms a drop-down passage 12*a* may be formed in a center of plate 12 when viewed in a plan view. The drop-down passage 12*a* may be in fluid communication with the upper reservoir 31 via the outflow port 31*b*. As shown in FIGS. 2 and 3E, through holes that form ten supply passages 14*a* may be formed in the lower layer plate 14. Each supply passage 14*a* may be respectively in fluid communication with an ink supply port 101 (refer to FIG. 5) positioned in the passage unit 9 of the head body 2. A plurality of grooves that allow an adhesive to escape may be formed in the vicinity of the through holes that form the supply passages 14*a*. As shown from FIGS. 2 and 3D, a hole that forms a branch passage 13*a* that functions as an ink reservoir may be formed in the intermediate layer plate 13. The branch passage 13*a* may be in fluid communication with the drop-down passage 12*a* and each supply passage 14*a*. The drop-down passage 12*a*, the branch passage 13*a*, and the supply passage 14*a* form a lower reservoir 41.

In operation, when printing normally, the discharge port 31*c* is blocked by the valve 50. Then, as shown by the black arrows in FIG. 2, ink from the ink channel flows into the upper reservoir 31 via the supply side joint portion 30*a* and the inflow port 31*a*. The ink that that has flowed into tie upper reservoir 31 passes from the upstream side of the main passage 35 through the filter 32, and flows into the downstream side of the main passage 35. Because the end neighboring area at the opposite side from the inflow port 31*a* may be tapered toward the outflow passage 37 in the downstream side of the main passage 35, the flow rate of the inflowing ink increases as it flows into the outflow passage 37. The ink that has flowed into the outflow passage 37 flows out to the lower reservoir 41 via the outflow port 31*b*. In the lower reservoir 41, the ink from the upper reservoir 31 flows into the branch passage 13*a* via the drop-down passage 12*a*. The ink that flows into the branch passage 13*a* reaches each supply passage 14*a*, and then is supplied to the passage unit 9 (refer to FIG. 5) via the ink supply ports 101.

On the other hand, when performing a discharge operation for discharging air that remains in the upper reservoir 31 to the outside, the discharge port 31*c* is opened by the valve 50. At this time, ink, which has flowed into the upper reservoir 31 from the inflow port 31*a* via the supply side joint portion 30*a*, flows into the upstream side of the main passage 35. Because the end neighboring area at the opposite side from the inflow port 31*a* may be tapered toward the discharge passage 36 in the upstream side of the main passage 35, the flow rate of the ink increases as it flows into the discharge passage 36. The ink that has flowed into the discharge passage 36 then is discharged to the outside via the discharge port 31*c*, the discharge side joint portion 30*b*, and the valve 50. At this time, even if air bubbles are included within the ink that flows in from the inflow port 31*a*, the air bubbles readily may be discharged with the ink from the discharge port 31*c*.

Referring to FIG. 4, the valve 50 opens and closes the discharge port 31*c*. The valve 50 may comprise a valve body 51 and a valve plunger 52. The valve body 51 may comprise a valve chamber 56 which may have a rectangular solid shape, a support wall 54 which may be connected to an upper surface of the valve chamber 56 and may have a tubular shape, and a valve side joint portion 55 which may be connected to the lower surface of the valve chamber 56 and may have a tubular shape. The support wall 54 supports the valve plunger 52, such that it may slide in the upwards-downwards direction. A groove 57 may be formed all around the periphery of the valve plunger 52. An O-ring (not shown) that functions as a sealing member may be fitted into the groove 57. Because of the O-ring, a sliding surface (inner wall surface) of the support wall 54 and the valve plunger 52 may be disposed in a water-tight manner. The valve side joint portion 55 may be connected to the discharge side joint portion 30*b* positioned in the upper surface of the reservoir unit 3. The valve side joint portion 55 may be inserted into the discharge side joint portion 30*b* so as to mutually connect the two members. At this time, the valve side joint portion 55 may be in fluid communication with the upper reservoir 31 (the upstream side with respect to the filter 32) via the discharge port 31*c* of the reservoir unit 3.

The valve plunger 52 may have a generally cylindrical shape which extends in one direction, a cylindrical sealing member 62 may be attached to a tip end neighborhood area thereof (the lower end in the figure), and a disk shaped knob 64 may be attached to an upper end neighborhood area. The sealing member 62 may be an elastic member comprising rubber or the like. In addition, there may be a slight gap between a side periphery surface of the sealing member 62 which is parallel to the axis thereof and the inner wall surface of the valve chamber 56 which faces the side periphery surface. Moreover, ink may flow by passing through this gap. An internal passage 65 may be formed inside the valve plunger 52, and may extend from an opening 61*a* formed in the top end surface of the valve plunger 52 to an opening 61*b* formed in the periphery wall above the sealing member 62. The valve plunger 52 may be supported by the support wall 54, such that the opening 61*b* and the sealing member 62 are disposed within the valve chamber 56. Furthermore, an ink channel for discharging ink may be connected to the upper end portion of the valve plunger 52, and the ink channel may be in fluid communication with the internal passage 65 via the opening 61*a*.

Figure 4B:
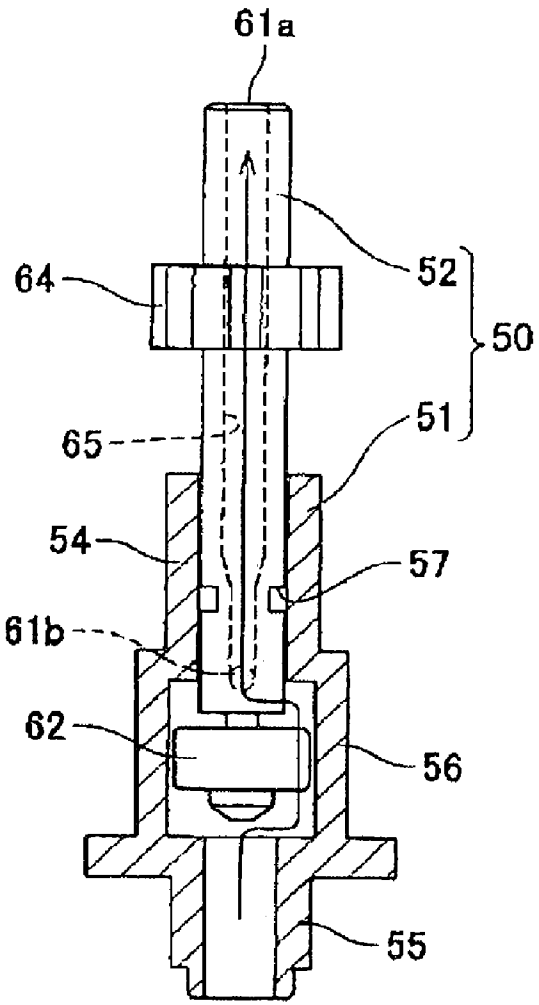
FIG. 4 is a cross-sectional view of a valve, according to an embodiment of the present invention.
Figure 4A:
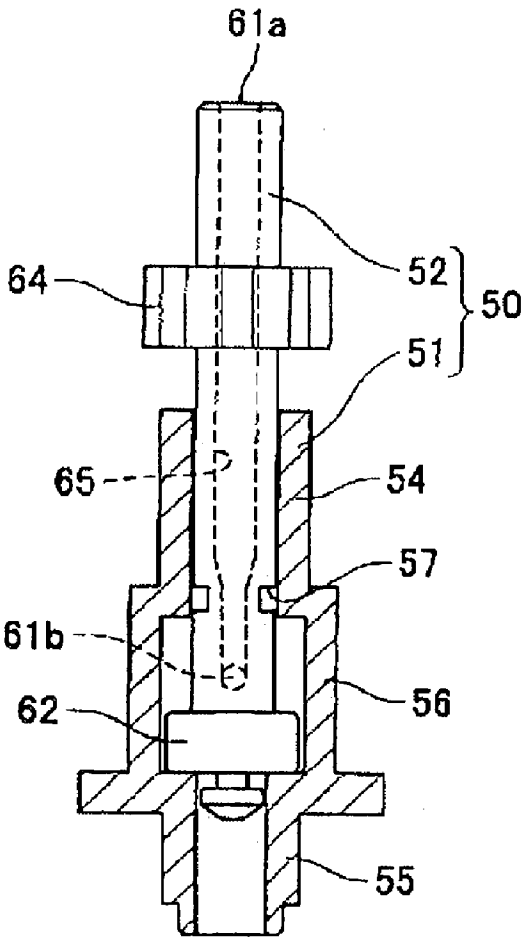

Referring to FIG. 4A, if the knob 64 is operated to push the valve plunger 52 in the downwards direction, the lower surface of the sealing member 62 closes the valve side joint portion 55. As a result, the discharge port 31*c* of the reservoir unit 3 is sealed. Moreover, as shown in FIG. 4B, if the knob 64 is operated to push the valve plunger 52 in the upward direction, the sealing member 62 opens the valve side joint portion 55. As a result, the internal passage 65 of the valve plunger 52, the valve chamber 56, and the valve side joint portion 55 communicate with each other, and the discharge port 31*c* of the reservoir unit 3 is opened. At this time, ink discharged from the discharge port 31*c* is discharged to the outside by passing through the valve side joint portion 55, the valve chamber 56, and the internal passage 65 (refer to the arrow shown in the figure).

Referring to FIG. 5, the head body 2 may comprise the passage unit (first passage member) 9, and four of the actuator unit 21 that are fixed to an upper surface 9*a* of the passage unit 9. Referring to FIG. 6, the actuator unit 21 may comprise a plurality of actuators which face the pressure chambers 110. The actuator unit 21 functions to selectively apply ejection energy to the ink within the pressure chambers 110 formed in the passage unit 9.

The passage unit 9 may be a rectangular solid shape, and may have about the same flat tabular shape as the plate 14 of the reservoir unit 3. A total of ten of the ink supply ports 101 may be positioned in the upper surface 9*a* of the passage unit 9 so as to correspond with the supply passages 14*a* (refer to FIG. 2) of the reservoir unit 3. A manifold passage 105 which is in fluid communication with the ink supply ports 101 and auxiliary manifold passages 105*a* that branch out from the manifold passage 105 may be formed within the passage unit 9. The ink Section surface 108*a* in which the plurality of nozzles 108 are arranged in a matrix pattern may be formed in the lower surface of the passage unit 9, as shown in FIGS. 6 and 7. The plurality of the pressure chambers 110 may be disposed in a matrix arrangement, similar to that of the nozzles 108, in a fixed surface of the actuator unit 21 in the passage unit 9.

In this embodiment, the pressure chambers 110 may be in rows in the longitudinal direction of the passage unit 9 and may be positioned at equal distances apart. There may be 16 rows of the pressure chambers 110 that are parallel to each other in the lateral direction. The number of pressure chambers 110 included in each pressure chamber row may gradually reduced in accordance with the external shape (a trapezium shape) of the actuator unit 21 from the long side to the short side thereof. The nozzles 108 may be arranged in a similar manner.

Referring to FIG. 7, the passage unit 9 may comprise nine metal plates comprising stainless steel or the like, and may comprise a cavity plate 122, a base plate 123, an aperture plate 124, a supply plate 125, manifold plates 126, 127, 128, a cover plate 129, and a nozzle plate 130. The plates 122-130, may have rectangular flat tabular shapes which have a long side that extends in the main scanning direction.

Through-holes that correspond with the ink supply ports 101 (refer to FIG. 5) and generally rhomboid shaped through holes that correspond with the pressure chambers 110 may be formed in the cavity plate 122. The base plate 123 may be formed with connection holes which connect the pressure chambers 110 and the apertures 112, connection holes which connect the pressure chambers 110 and the nozzles 108, and connection holes (not shown) which connect the ink supply ports 101 and the manifold passage 105 for each pressure chamber 110. The aperture plate 124 may be formed with through holes which form the apertures 112, connection holes which connect the pressure chambers 110 and the nozzles 108, and connection holes (not shown) which connect the ink supply ports 101 and the manifold passage 105 for each pressure chamber 110. The supply plate 125 may be formed with connection holes which connect the aperture 112 and the auxiliary manifold passages 105*a*, connection holes which connect the pressure chambers 110 and the nozzles 108, and connection holes (not shown) which connect the ink supply ports 101 and the manifold passage 105 for each pressure chamber 110. The manifold plates 126, 127, and 128 may be formed with connection holes which connect the pressure chambers 110 and the nozzles 108, and through holes that, when laminating is performed, form the mutually connecting manifold passage 105 and the auxiliary manifold passage 105*a*, for each pressure chamber 110. The cover plate 129 may be formed with connection holes which connect the pressure chambers 110 and the nozzles 108 for each pressure chamber 110. The nozzle plate 130 may be formed with holes that correspond to the nozzles 108 for each pressure chamber 110.

The plates 122-130 may be mutually aligned and laminated, thereby forming inside the passage unit 9 a plurality of individual ink passages 132 which extend from the manifold passage 105 to the auxiliary manifold passages 105*a*, and then from discharge ports of the auxiliary manifold passages 105*a* to the nozzles 108 via the respective pressure chambers 110.

Referring to FIGS. 5-7, ink supplied from the reservoir unit 3 to the passage unit 9 via the ink supply ports 101 enters the manifold passage 105 and then is split at the auxiliary manifold passages 105*a*. The ink in the auxiliary manifold passages 105*a* flows into each ink passage 132 and reaches the nozzles 108 via the apertures 112 that act as diaphragms and the pressure chambers 110.

Referring to FIG. 5, the four actuator units 21 respectively may have flat tabular trapezoid shapes, and may be arranged in a zigzag pattern to avoid the ink supply ports 101. In addition, each parallel facing side of the actuator units 21 may be aligned with the longitudinal direction of the passage unit 9, and the diagonal sides of neighboring actuator units 21 may be positioned, such that they overlap with each other when viewed along the width direction of the passage unit 9 (the sub-scanning direction).

Figure 8A:
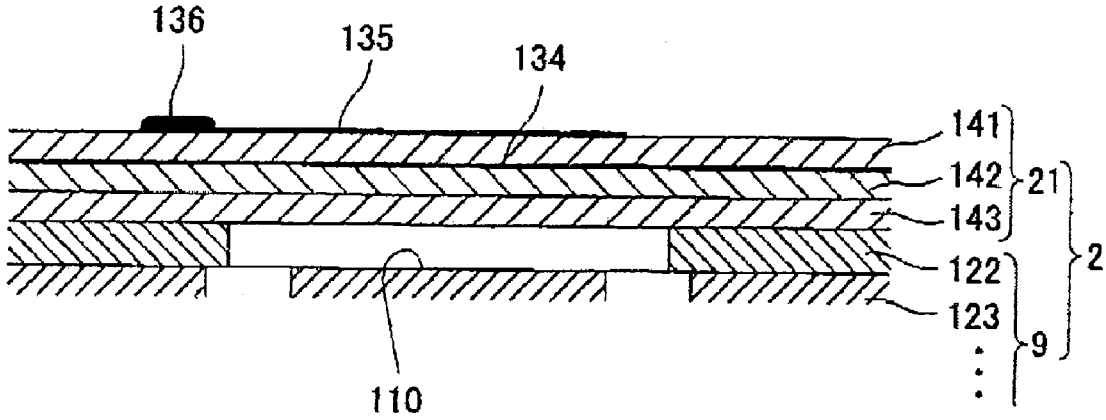
FIG. 8 is an expanded view of an actuator unit, according to an embodiment of the present invention.
Figure 8B:
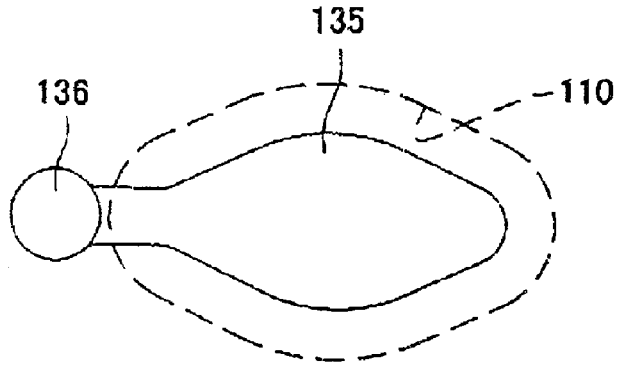

Referring to FIG. 8A, the actuator unit 21 may comprise three piezoelectric sheets 141, 142, 143 which are which comprise a ceramic material of the lead zirconate titanate (PZT) family having ferroelectricity. Individual electrodes 135 may be formed at positions on top of the piezoelectic sheet 141, which is the upper layer, that face the pressure chambers 110. A common electrode 134 may be positioned between the upper layer piezoelectric sheet 141 and the piezoelectric sheet 142, which is the layer beneath. The shared electrode 134 may cover the entire sheet surface. The individual electrodes 135, as shown from FIG. 8B, may have a generally rhomboid-like flat tabular shape which is substantially similar to the shape of the pressure chambers 110. One of the pointed corner sections of each generally rhomboid-shaped individual electrode 135 may be formed to extend, and a circular land 136 may be provided at a tip end thereof Each circular land 136 may be electrically connected to the respective individual electrode 135.

The common electrode 134 may be maintained at the sine ground potential in the regions which corresponds to all of the pressure chambers 110. On the other hand, the individual electrodes 135 may be structured such that each land 136 is connected via a Flexible Printed Circuit ("FPC," not shown) to each terminal of a driver IC (not shown), such that the potential may be selectively controlled. More specifically, in the actuator unit 21, the respective sections positioned between the individual electrodes 135 and the pressure chambers 110 function as individual actuators, and thus, a plurality of actuators are provided in accordance with the number of pressure chambers 110.

With respect to the drive method of the actuator unit 21, the piezoelectric sheet 141 is polarized in the thickness direction thereof, and the individual electrodes 135 are set to a different potential to the common electrode 134. Accordingly, an electric field is applied to the piezoelectric sheet 141 in the polarization direction, whereby the section of the piezoelectric sheet 141 to which the electric field is applied functions as an active deformation area as a result of the piezoelectric effect. More specifically, the actuator unit 21 may be a unimorph type, in which the single piezoelectric sheet 141 on the upper side away from the pressure chambers 110 functions as a layer including an active section, and the two piezoelectric sheets 142 and 143 on the lower side adjacent to the pressure chambers 110 function as non-active layers. As shown from FIG. 8A, because the piezoelectic sheets 141-143 are fixed on the upper surface of the cavity plate 122 that defines the pressure chambers 110, there may be a difference in the generated deformation in the in-plane direction between the section of the piezoelectric sheet 141 to which the electric field is applied and the piezoelectric sheets 142 and 143 there below. Accordingly, the piezoelectric sheets 141-143 deform (unimoprh deformation) so as to protrude toward the side of the pressure chambers 110. Consequently, pressure (ejection energy) is applied to the ink inside the pressure chambers 110, whereby ink droplets are ejected from the nozzles 108.

As described above, the inkjet head 1 is connected to the ink channel. Consequently, the supply side joint portion 30*a* is in fluid communication with an ink tank (not shown) that functions as an ink supply source. A pump (not shown) may be inserted in an intermediate section of the ink channel, and forcibly feeds ink therethrough. During normal printing operations, the pump functions as a passage, and the discharge port 31*c* is closed by the valve 50. Supply of ink during printing takes place spontaneously due to an ink meniscus formed by the nozzles 108.

When the ink channel is removed, such as when the ink tank is replaced, air bubbles may enter the ink supply passage. At such time, the discharge operation for discharging the ink including the air bubbles may be performed. At this time, the other end of the ink channel connected to a waste ink tank (not shown) is connected to the valve plunger 52 of the valve 50 (refer to FIG. 4). After this, the valve 50 may be operated to open the discharge port 31*c*. Then, the pump (not shown) may be driven to forcible supply the ink in the ink channel connected to the supply side joint portion 30*a*. Consequently, the ink in the ink channel flows into the upper reservoir 31 via the supply side joint portion 30*a* and the inflow port 31*a*. At this time, in the upper reservoir 31, because there is substantial passage resistance caused by the filter 32, the passage resistance of the flow from the upstream side of the main passage 35 to the outflow passage 37 through the filter 32 may be greater than the passage resistance of the flow from the upstream side of the main passage 35 to the discharge passage 36. Consequently, when the discharge port 31*c* is opened, almost all of the ink that has flowed into the upper reservoir 31 may flow into the discharge passage 36 from the upstream side of the main passage 35. Then, the ink that has flowed into the discharge passage 36 may be discharged from the discharge port 31*c*.

At this time, air that remained in the ink channel and in the upper reservoir 31 along with the ink may be discharged. The ink and the air discharged from the discharge port 31*c* readily may be discharged to the waste ink tank via the valve side joint portion 55, the valve chamber 56, and the ink channel connected to the valve plunger 52. In addition, the discharge operation may be completed in a reduced amount of time, and thus, a wasted amount of ink may be reduced when air (air bubbles) is discharged through the filter 32. Furthermore, after it has been confirmed that all of the air remaining in the upper reservoir 31 has been discharged, the valve 50 may be operated once again to close the discharge port 31*c*, and the ink channel connected to the valve plunger 52 may be removed.

According to this embodiment of the present invention, the inflow port 31*a* and the discharge port 31*c* may be positioned adjacent to the one end in the longitudinal direction of the passage member 11. Accordingly, the ink channel readily may be connected to the supply side joint portion 30*a* which is connected to the inflow port 31*a* and the valve plunger 52 of the valve 50. In addition, the ink channels may be concentrated at one side of the inkjet head 1, and thus, the ink channels may be readily removed. Furthermore, because the inflow port and the discharge port are not positioned at the other end of the upper reservoir 31, design freedom with respect to the length in the longitudinal direction of the passage member 11 in the upper reservoir 31 may be increased.

In addition, because the main passage 35 and the discharge passage 36 are positioned parallel to and on the same plane as the ink ejection surface 108*a*, height may be reduced in the direction orthogonal to the ink ejection surface 108*a* of the passage member 11.

Moreover, the main passage 35 and the discharge passage 36 are exposed to the outside atmosphere via the film 33*a* positioned between the outside atmosphere and the surface of the main passage 35 and the discharge passage 36. Thus, a damping function may be provided for the main passage 35 and the discharge passage 36 using a reduced cost structure.

In addition, the main passage 35 and the discharge passage 36 are in fluid communication with each other at the upstream side of the filter 32, and the main passage 35 and the outflow passage 37 are in fluid communication with each other at the downstream side of the filter 32. Accordingly, ink that is filtered by the filter 32 flows out to the passage unit 9 via the outflow port 31*b*. Consequently, clogging of the nozzles 108 of the passage unit 9 may be prevented or substantially reduced. Furthermore, air bubbles, foreign objects, or the like in the passage to the upstream side of the filter 32 may be discharged surely and in a reduced amount of time, such that ink may not wastefully consumed.

In addition, the end neighboring area at the opposite side to the inflow port 31*a* of the main passage 35 is tapered toward the communication hole which is in fluid communication with the discharge passage 36. Accordingly, the ink flow rate may increases as the main passage 35 tapers, which may increase the likelihood that ink will flow into the discharge passage 36 from the main passage 35.

Moreover, because the inkjet head 1 has the valve 50 that opens and closes the discharge port 31*c*, the discharge operation for discharging ink from the discharge port 31*c* may be performed surely.

In addition, the upper reservoir 31 extends from the central section of the passage member 11 in the longitudinal direction to the one end section in the longitudinal direction of the passage member 11. Accordingly, in the passage member 11, it may be possible to form another independent upper reservoir from the central section in the longitudinal direction to the other end section. As a result, a simple design change may allow the inkjet head to print using two colors.

Next, an example of a modified form of this embodiment will be explained. In this embodiment, the passage member 11 and the valve body 51 are separate members. However, the passage member 11 and the valve body 51 may be integral. Consequently, reduced cost production of the valve 50 may be promoted.

In another embodiment of the present invention, the inkjet head 1 may be configured to print using a plurality of colors, e.g., two colors. This embodiment of the present invention may be substantially similar to the above-described embodiments of the present invention. Therefore, only those differences between this embodiment of the present invention and the above-described embodiments of the present invention may be discussed with respect to this embodiment of the present invention.

In this embodiment of the present invention the reservoir unit may have a laminated structure in which the passage member (second passage member) 211 which extends in the main scanning direction and three plates, e.g., the plates 212, 213, and 214, may be laminated together. The three plates 212-214 may have a rectangular flat tabular shape, and may extend in the main scanning direction (refer to FIG. 2).

Figure 9A:
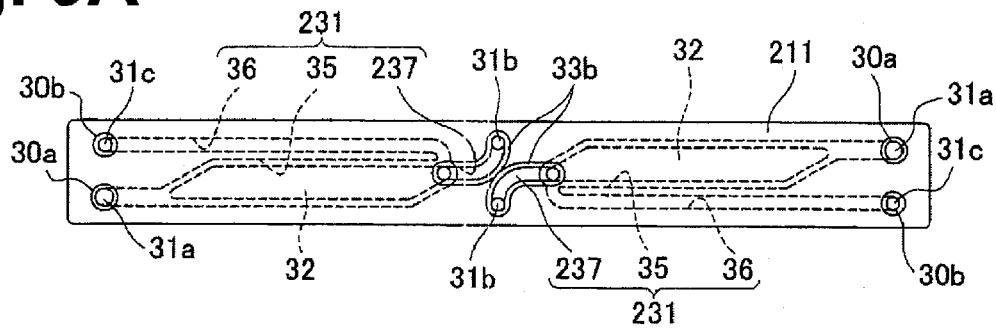
FIG. 9 is a plan view of structural elements which comprise a reservoir unit, according to another embodiment of the present invention.
Figure 9B:
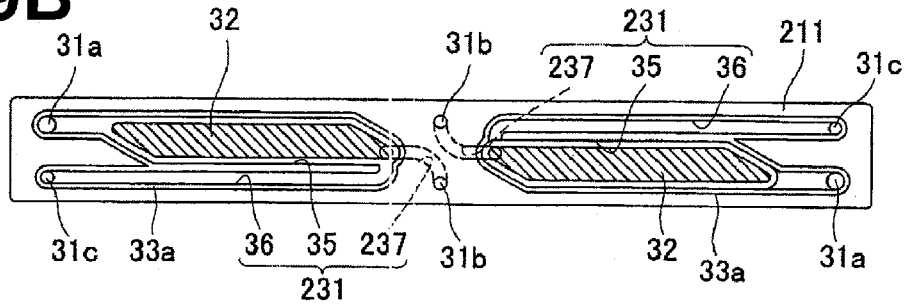

Referring to FIGS. 9A and 9B, two upper reservoirs 231 may be positioned within the passage member 211. In addition, inflow ports (supply ports) 31*a* and discharge ports 31*c* may be arranged in a row in the lateral direction adjacent to each end in the longitudinal direction of an upper surface of the passage member 211. Similarly, two of the outflow ports 31*b* may be arranged in a row in the lateral direction in the central section in a lower surface of the passage member 211. In the upper reservoir 231, the shape of an outflow passage 237 is slightly different to that of the upper reservoir 31 of the above-described embodiments of the present invention. Nevertheless, because both members are substantially similar, a more detailed explanation of the upper reservoir 231 is omitted. When seen in a plan view, the two upper reservoirs 231 may be substantially symmetrical, e.g., may have point symmetry, with respect to the center of the passage member 211. Further, one of the upper reservoirs 231 extends from the central section of the passage member 211 in the longitudinal direction to the one (left side) end section in the longitudinal direction of the passage member 211, and the other upper reservoir 231 extends from the central section of the passage member 211 in the longitudinal direction to the other (right side) end section in the longitudinal direction of the passage member 211.

Figure 9C:
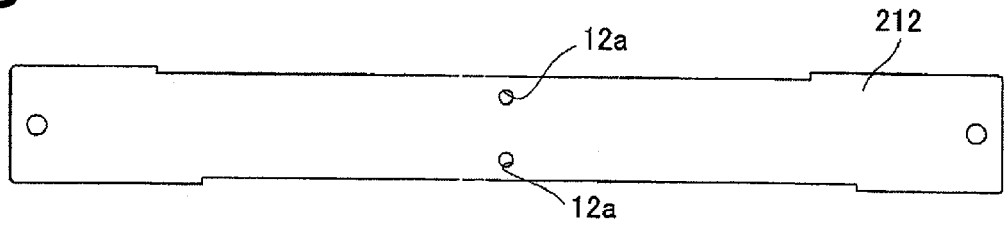
Figure 9D:
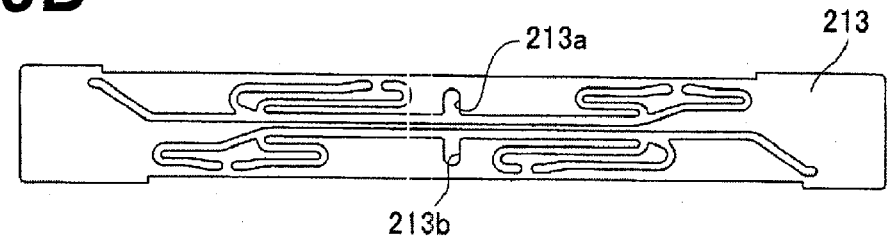

Referring to FIG. 9C, among the plates 212, 213, and 214, two through holes which form two of the drop-down passages 12*a* may be arranged in a row in the lateral direction in the center of the upper layer plate 212, when viewed in a plan view. The drop-down passages 12*a* may be in fluid communication with the upper reservoir 231 via each of the outflow ports 31*b*. Though holes (refer to FIGS. 2 and 3E) which form the ten supply passages 14*a* may be formed in the lower layer plate 14. Each supply passage 14*a* respectively may be in fluid communication with each ink supply port 101 (refer to FIG. 5) positioned in the passage unit 9. In addition, referring to FIG. 9D, a hole which forms a branch passage 213*a* and a hole which forms a branch passage 213*b* are formed in the intermediate layer plate 213. The branch passage 213*a* may be in fluid communication with the one of the drop-down passages 12*a* which is disposed to one side in the lateral direction of the plate 212 (the upper side in the figure) and the five of the supply passages 14*a* which are disposed to one side in the lateral direction of the plate 14. The branch passage 213*b* may be in fluid communication with the one of the drop-down passages 12*a* which is disposed to the other side in the lateral direction (the bottom side in the figure) and the five supply passages 14*a* which are disposed to the other side in the lateral direction. The drop-down passages 12*a*, and the corresponding branch passage 213*a* and branch passage 14*a* form a single lower reservoir which corresponds to each one of upper reservoirs 231 (refer to FIG. 2).

According to this embodiment, the same color ink may be supplied to the inflow ports 31*a* of each upper reservoirs 231, such that the inkjet head 1 prints using a single color, or a different color ink may be supplied to the inflow ports 31*a* of each upper reservoirs 231, such that the inkjet head 1 prints using two colors.

In addition, because the two upper reservoirs 231 may have point symmetry with respect to the center of the passage member 211 when viewed in a plan view, the flow of ink in each upper reservoir 231 may be uniform. Consequently, ink droplet ejection performance may be more stable.

Figure 10:
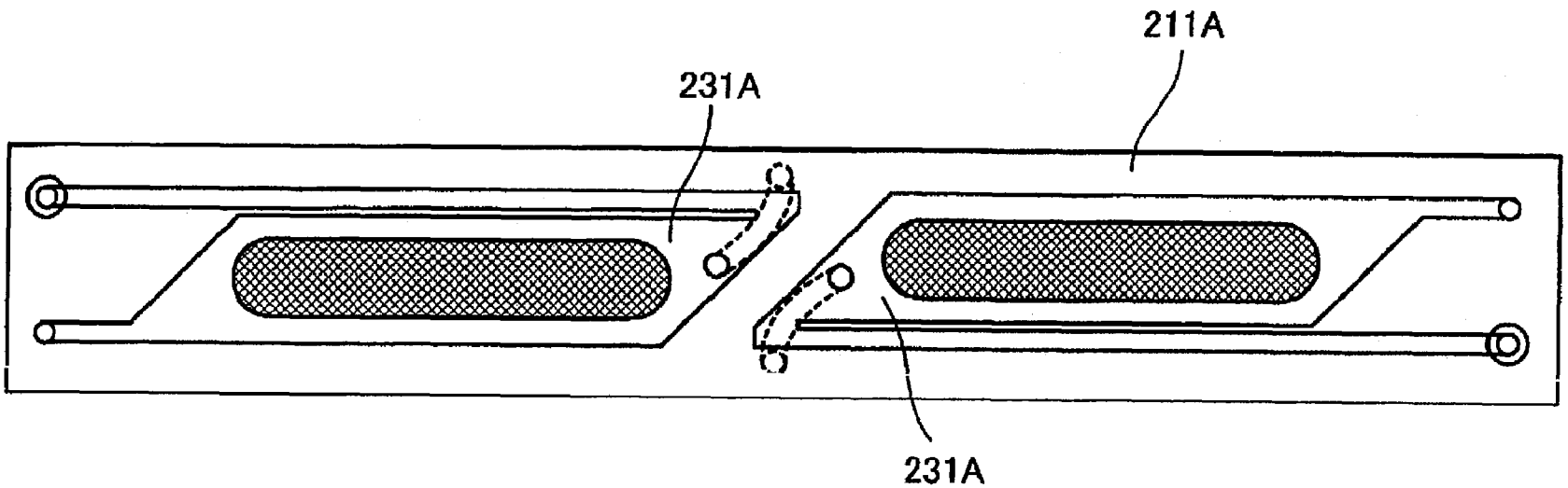
FIG. 10 is a diagram of a passage member, according to another embodiment of the present invention.

This embodiment may adopt a structure in which just one of the upper reservoirs 231 is positioned between the central section of the passage member 211 in the longitudinal direction and the end section at one side in the longitudinal direction of the passage member 211, and just the other upper reservoir 231 is positioned between the central of the passage member 211 in the longitudinal direction and the other end in the longitudinal direction of the passage member 211. Nevertheless, as shown in FIG. 10, a pair of upper reservoirs 231A may extend from respective ends of a passage member 211A as far as points which are beyond a central area in the longitudinal direction of the passage member 211A. In this case, the pair of upper reservoirs 231A may be positioned in an overlapping manner in the central area of the passage member 211A, and may share a passage wall. Consequently, the capacity of the upper reservoirs 231A may be increased, whereby the film that defines the upper reservoirs 231 A may also have a increased surface area. Accordingly, the damping effect of the film may be improved.

Hereinabove, embodiments of the present invention have been described. Nevertheless, the invention is not limited to the described embodiments. For example, in the above described first and second embodiments, the main passage 35 and the discharge passage 36 are positioned to be parallel to and on the same plane as the ink ejection surface 108*a*. However, the main passage and the discharge passage may be positioned on mutually different planes as chosen.

In addition, in the above described embodiments, the main passage 35 and the discharge passage 36 are exposed to the outside atmosphere via the film 33*a* positioned between the outside atmosphere and the surface of the main passage 35 and the discharge passage 36. However, the main passage 35 and the discharge passage 36 may be exposed to the outside atmosphere via a plurality of films. Alternatively, just one of the main passage 35 and the discharge passage 36 may be exposed to the outside atmosphere via a film, or neither of the main passage 35 and the discharge passage 36 may be exposed to the outside atmosphere via a film.

In the above described embodiments, the main passage 35 has a generally parallelogram-like shape when seen in a plan view. However, the main passage may be given any chosen shape like a generally elliptical shape. In addition, the discharge passage may also be given any chosen shape like a generally elliptical shape. In this case, it is favorably that the discharge passage is exposed to the outside atmosphere via a film. As a result, the reservoir unit may allow a increased damping function to be provided In the above described embodiments, the inkjet head 1 includes the valve 50 that opens and closes the discharge port 31*c*. However, the valve 50 need not be provided, and the structure may use another method to open and close the discharge port 31*c*.

Moreover, in the above described embodiments of FIGS. 1-8, the upper reservoir 31 may extend from the central section of the passage member 11 in the longitudinal direction to the one end section in the longitudinal direction of passage member 11. Nevertheless, the upper reservoir may be positioned in any chosen region. For example, the upper reservoir may extend throughout the length of the passage member.

In the above described embodiments of FIGS. 9 and 10, the two upper reservoirs 231 are structured so as to have point symmetry with respect to the center of the passage member 211 when viewed in a plan view. Nevertheless, each reservoir may have any chosen shape. For example, the two upper reservoirs may be structured to have line symmetry with respect to the center of the passage member when viewed in a plan view.

In the above described examples, the discharge operation is performed when the ink tank is replaced. Nevertheless, the discharge operation may be performed during normal operation or on a regular basis. As a result, foreign objects or air bubbles that have accumulated on the surface of the filter 32 may be discharged, whereby filtering performance of the filter 32 may be maintained and restored.

While the invention has been described in connection with embodiments of the invention, it will be understood by those skilled in the art that variations and modifications of the embodiments described above may be made without departing from the scope of the invention. Other embodiments will be apparent to those skilled in the art from a consideration of the specification or from a practice of the invention disclosed herein. It is intended that the specification and the described examples are consider exemplary only, with the true scope of the invention indicated by the following claims.

What is claimed is:

1. An inkjet head comprising:

a first passage member comprising an ink ejection surface having a plurality of ink ejection holes formed therethrough; and a second passage member having at least one ink passage formed therein, wherein the at least one ink passage comprises:

a supply port configured to receive an ink from an outside of the second passage member and to dispense the ink into the at least one ink passage;

a discharge port configured to dispense the ink from the at least one ink passage to the outside of the second passage member;

an outflow port configured to dispense the ink from the at least one ink passage toward the first passage member, wherein the supply port and the discharge port are each positioned adjacent to a predetermined end of the second passage member;

a first ink passage portion which is configured to be in fluid communication with the supply port and extends from the supply port toward the outflow port; and a second ink passage portion which is configured to be in fluid communication with the discharge port and extends from the discharge port toward the outflow port, wherein the first ink passage portion and the second ink passage portion are configured to be in fluid communication with each other in an area adjacent to the outflow port.

2. The inkjet head according to claim 1, wherein the first ink passage portion and the second ink passage portion are positioned parallel to and in the same plane as the ink ejection surface.

3. The inkjet head according to claim 1, further comprising a flexible film attached to a surface of the first ink passage portion and the second ink passage portion which is parallel to the ink ejection surface, wherein the first ink passage portion and the second ink passage portion are exposed to an outside atmosphere via the flexible film positioned between the outside atmosphere and the surface of the first ink passage portion and the second ink passage portion.

4. The inkjet head according to claim 1, further comprising a filter disposed within the first ink passage portion, wherein the outflow port is positioned within the first ink passage portion at a downstream side of the filter, and the first ink passage portion and the second ink passage portion are configured to be in fluid communication with each other at an upstream side of the filter.

5. The inkjet head according to claim 1, wherein the first ink passage portion is tapered toward the second ink passage portion in the area adjacent to the outflow port, and at least a portion of the first ink passage portion and at least a portion of the second ink passage portion share a passage wall.

6. The inkjet head according to claim 1, further comprising a valve configured to selectively open and close the discharge port.

7. The inkjet head according to claim 6, wherein the valve comprises:

a valve chamber configured to be in fluid communication with the at least one ink passage via the discharge port; and an elastic member configured to selectively move between a first position in which the elastic member closes the discharge port and a second position in which the elastic member opens the discharge port, wherein the second passage member and the valve chamber are integral.

8. The inkjet head according to claim 7, wherein the at least one ink passage is formed between the predetermined end of the second passage member and substantially a center of the second passage member.

9. The inkjet head according to claim 7, wherein the at least one ink passage comprises a first ink passage and a second ink passage, wherein the first ink passage is formed between the predetermined end of the second passage member and substantially a center of the second passage member, and the second ink passage is formed between substantially the center of the second passage member and a further end of the second passage member opposite the predetermined end of the second passage member.

10. The inkjet head according to claim 9, wherein the first ink passage and the second ink passage are substantially symmetrical.

11. An inkjet head comprising:

a passage member having at least one ink passage formed therein, wherein the at least one ink passage has a first end and a second end opposite the first end, and the at least one ink passage comprises:

a supply port configured to receive an ink from an outside of the passage member and to dispense the ink into the at least one ink passage; and a discharge port configured to dispense the ink from the at least one ink passage to the outside of the passage member, wherein the supply port and the discharge port are each positioned adjacent to a predetermined end of the passage member.

12. The inkjet head of claim 11, wherein the passage member further comprises:

a first ink passage portion which is configured to be in fluid communication with the supply port and extends from the supply port in a predetermined direction toward the outflow port; and a second ink passage portion which is configured to be in fluid communication with the discharge port and extends from the discharge port in the predetermined direction, wherein the first ink passage portion and the second ink passage portion are configured to be in fluid communication with each other.

13. The inkjet head of claim 12, wherein the first ink passage portion is connected to the second ink passage portion at substantially a center of the passage member.

14. The inkjet head according to claim 13, wherein the first ink passage portion is tapered toward the second ink passage portion at substantially the center of the passage member, and at least a portion of the first ink passage portion and at least a portion of the second ink passage portion share a passage wall.

15. The inkjet head according to claim 11, further comprising a filter disposed within the first ink passage portion.

16. The inkjet head of claim 11, further comprising a film attached to the passage member, wherein the film seals the passage member.

17. The inkjet head according to claim 11, further comprising a valve configured to selectively open and close the discharge port.

18. The inkjet head according to claim 17, wherein the valve comprises;

a valve chamber configured to be in fluid communication with the at least one ink passage via the discharge port; and an elastic member configured to selectively move between a first position in which the elastic member closes the discharge port and a second position in which the elastic member opens the discharge port.

19. The inkjet head of claim 18, wherein the passage member and the valve chamber are integral.

* * * * *